US007754953B2

(12) United States Patent
Takegawa

(10) Patent No.: US 7,754,953 B2
(45) Date of Patent: Jul. 13, 2010

(54) TENSION NUT LOCK SYSTEM FOR AN INSTRUMENT

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 128 days.

(21) Appl. No.: 12/273,976

(22) Filed: Nov. 19, 2008

(65) Prior Publication Data

US 2010/0122622 A1 May 20, 2010

(51) Int. Cl.
*G10D 13/02* (2006.01)

(52) U.S. Cl. ..... 84/422.1; 411/105; 411/130; 411/197; 285/87

(58) Field of Classification Search ..... 84/422.1, 84/366, 422.2, 422.3, 426; 411/105, 130, 411/197; 285/87
See application file for complete search history.

(56) References Cited

U.S. PATENT DOCUMENTS

| | | | | |
|---|---|---|---|---|
| 613,776 | A | 11/1898 | Plain | |
| 1,070,844 | A * | 8/1913 | Roe | 411/329 |
| 2,051,899 | A * | 8/1936 | Rose | 285/87 |
| 2,642,108 | A | 6/1953 | Geistert | |
| 2,713,882 | A | 7/1955 | Wilkes | |
| 3,368,602 | A | 2/1968 | Boyd | |
| 3,807,774 | A * | 4/1974 | Heath, Jr. | 285/87 |
| 3,858,915 | A * | 1/1975 | De Vincent et al. | 285/320 |
| 5,058,450 | A | 10/1991 | Yoshigai | |
| 5,365,824 | A | 11/1994 | Hoshino | |
| 5,773,736 | A | 6/1998 | Hsieh | |
| 5,798,472 | A | 8/1998 | Shigenaga | |
| 6,137,040 | A | 10/2000 | Hoshino | |
| 6,735,999 | B2 | 5/2004 | Smithson et al. | |
| 6,822,149 | B1 | 11/2004 | Liao | |
| 7,600,789 | B2 * | 10/2009 | Vyse et al. | 285/91 |
| 7,692,084 | B1 * | 4/2010 | Lai | 84/422.1 |

* cited by examiner

*Primary Examiner*—Jianchun Qin
(74) *Attorney, Agent, or Firm*—Berenatio & White, LLC

(57) ABSTRACT

A locking system to more accurately secure the foot pedal tension spring to the desired tension every time a tension adjustment is necessary. An adjustment screw is interconnected with the tension spring for adjusting the tension of the spring. A spring tension adjustment nut is threaded onto the adjustment screw. In accordance with the invention, a locking system is provided for locking the adjustment screw at one of a plurality of selected adjustment positions relative to the support and the foot pedal assembly in general. The selected adjustment positions are radially disposed about the central axis of rotation of said adjustment screw so that the adjustment screw may be locked into one of the selected adjustment positions relative to the support. With this locking system, the user may carefully select from a plurality of highly sensitive adjustment positions.

12 Claims, 6 Drawing Sheets

TENSION NUT LOCK SYSTEM FOR AN INSTRUMENT

BACKGROUND OF THE INVENTION

1. Field of the Invention

This invention relates to a spring adjustment mechanism for a beater of a drum pedal enabling free adjustment of the beater amplitude and the pedal height and particularly to assure that the tension on the return spring stays at a set level.

2. Description of Related Art

In a conventional beater mechanism for a bass drum as illustrated in FIGS. 1 and 2, a pair of supports 92 is erected at both sides of the base 91 of a drum pedal device 90. A beater rotary shaft 94 is rotatably supported at the top of the supports 92 through conventional bearings 93.

There is a beater mounting member 110 approximately at the center of the rotary shaft 94. Integral with the beater mounting member 110 is an operating member 120, which is in the shape of a wheel or sprocket. A beater head 115 is fixed to the beater mounting member 110 by screws 116 or other suitable fastener.

The drive member 120 comprises a sprocket or a partial sprocket, with a chain 121 having an end that is fixed at the drive member 120. The chain 121 is partially wound on the outer periphery of the drive member 120. The other end of the chain 121 is linked to a foot pedal 95. As the foot pedal 95 is pressed the chain 121 is pulled down. This rotates the drive member 120 which in turn rotates the beater, thereby causing the beater head 115 to beat the drum head surface D.

A spring 107 is tensioned to normally return the beater 115 to its original position automatically. The spring 107 is connected to the shaft 94 through a cam and hook assembly generally designated as 100 and 106.

Adjustment of the tension of the spring 107 in the above conventional device is done with an adjustment device 140 which is provided at the bottom of the spring 107. The adjustment device 140 comprises an adjustment screw 141, an adjustment nut 142 threaded on the screw 141 below the bracket 109 and a lock nut 143 threaded on the screw above the bracket 109. The adjustment screw 141 is inserted through an adjustment hole in the bracket 109 and is linked to the lower end of the spring 107. The screw is then secured from below the lower bracket 109 by the adjusting nut 142 and is locked in the selected adjusted position by tightening the lock nut 143 against the bracket 109.

For adjusting the tension of the spring 107, the lock nut 143 is loosened, and the adjusting nut 142 is rotated until the spring has a desired spring tension. Then the lock nut 143 is tightened against the lower bracket 109, thereby fixing the position of the adjustment screw 141.

In the above described mechanism of the prior art, during use of the drum pedal the adjustment nut may become loosened so that the set position of the desired spring tension is changed.

SUMMARY OF THE INVENTION

The present invention provides a system to more accurately secure the spring to the desired tension every time spring tension adjustment is necessary.

The spring adjustment mechanism for a drum pedal comprises at least one support; a beater shaft supported on the support and rotatable around the axis of the shaft; a drum beater connected to pivot toward and away from a drum as the shaft is rotated; a drive member fixed to the shaft; and a foot pedal connected with the drive member by a chain or other linkage system so that movement of the pedal moves the drive member to rotate the shaft for pivoting the drum beater toward and away from a drum head of a drum as the shaft is selectively rotated in opposite directions. A spring is hooked to the beater shaft such that the spring tension returns the beater shaft to a position of least spring tension.

An adjustment screw is interconnected with the spring for adjusting the tension of the spring, wherein the adjustment screw is movable with respect to the support and the beater shaft for adjusting the tension of the spring, and a spring tension adjustment nut is threaded onto the adjustment screw. In accordance with the invention, a locking system is provided for locking the adjustment screw at one of a plurality of selected adjustment positions relative to the support and the foot pedal assembly in general. The selected adjustment positions are radially disposed about the central axis of rotation of said adjustment screw so that the adjustment screw may be locked into one of the selected adjustment positions relative to the support.

With this locking system, the user may carefully select from a plurality of highly sensitive adjustment positions. In one embodiment, the locking system comprises a series of teeth disposed on an exterior surface of the adjustment nut whereby a latch spring that engages the series of teeth to define the selected adjustment positions. In another embodiment, the locking system comprises a series of dimples/bumps disposed on a projection extending from the support and a series of corresponding dimples/bumps disposed on the adjustment nut, whereby the series of bumps and dimples interlock to define the selected adjustment positions.

In the first embodiment, the user can visually and manually adjust the tension of the spring. In the second embodiment, the tension value can be adjusted to a desired level by the number of "clicks" that can be heard from the spring tension nut engaging with the flange holding the bolt.

Once the desired tension has been achieved, the spring tension nut can be locked in place by the latch engagement or the frictional engagement between the bumps and dimples. It is also envisioned that both locking systems may be used together, so that the spring tension will not change due to vibration or other causes. With either system, the spring tension may be adjusted with precision using equally spaced adjustment positions radially disposed on the adjustment nut—either around the outer periphery of the nut or circumferentially spaced around the side facing the flange on the support.

These and other benefits of the present invention will be apparent to those of skill in the art based on the following description and the appended drawings.

DETAILED DESCRIPTION OF PREFERRED EMBODIMENTS

Figure 3:
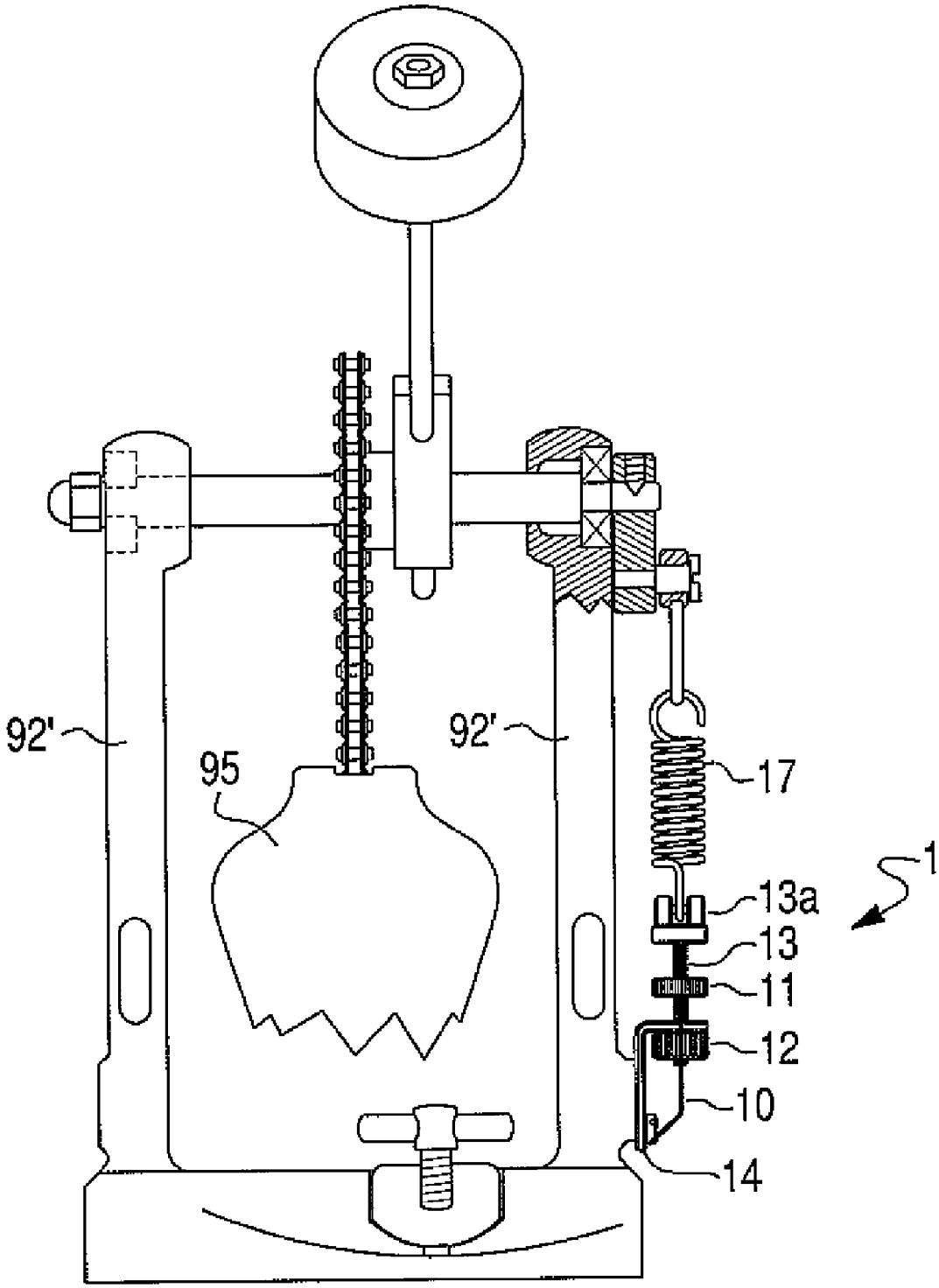
FIG. 3 is a rear view of the spring adjustment mechanism according to the present invention.
Figure 7:
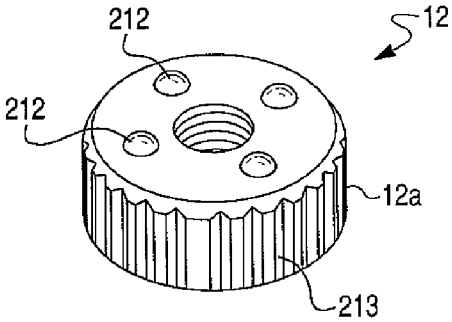
FIG. 7 is a top view of the spring tension adjustment nut.
Figure 8:
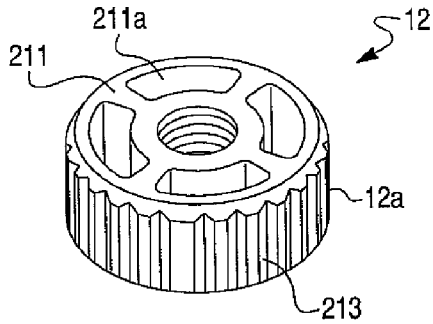
FIG. 8 is a bottom view of the spring tension adjustment nut.
Figure 9F:
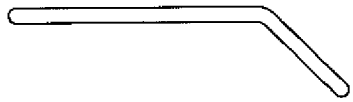
FIGS. 9*a*-9*f* illustrate the specific shape of the preferred latch clip member.
Figure 9C:
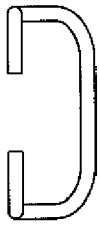
Figure 9D:
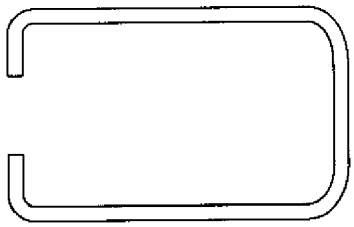
Figure 9E:
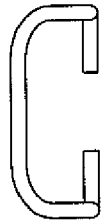
Figure 9A:
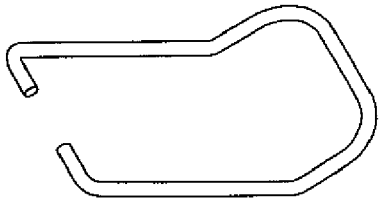
Figure 9B:
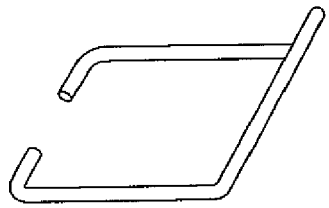

As shown in FIG. 3, the spring adjustment mechanism 1 is shown as a combination of a latch system that engages teeth on the adjustment nut 12 and/or a series of projections and dimples that frictionally interact between the adjustment nut 12 and the flange 14 provided on the support arm 92'. In accordance with this invention, one or both of these locking systems may be employed to achieve the benefits of this invention. It is noted that the latch system of FIGS. 4 and 5 may be used independently of the bumps and dimples shown in FIGS. 6-8.

Figure 5:
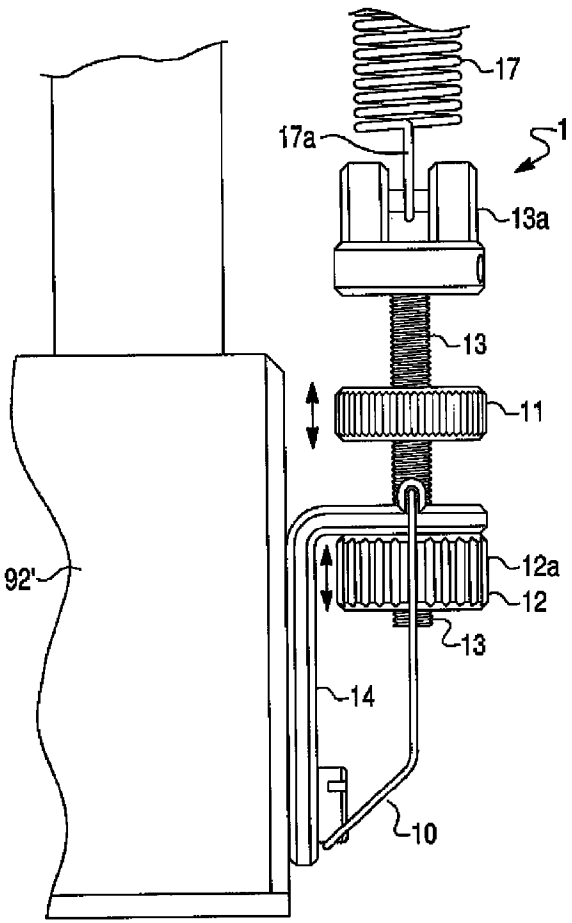
FIG. 5 is a side view of the threaded bolt and flange assemblies with the latch in an locked position.
Figure 4:
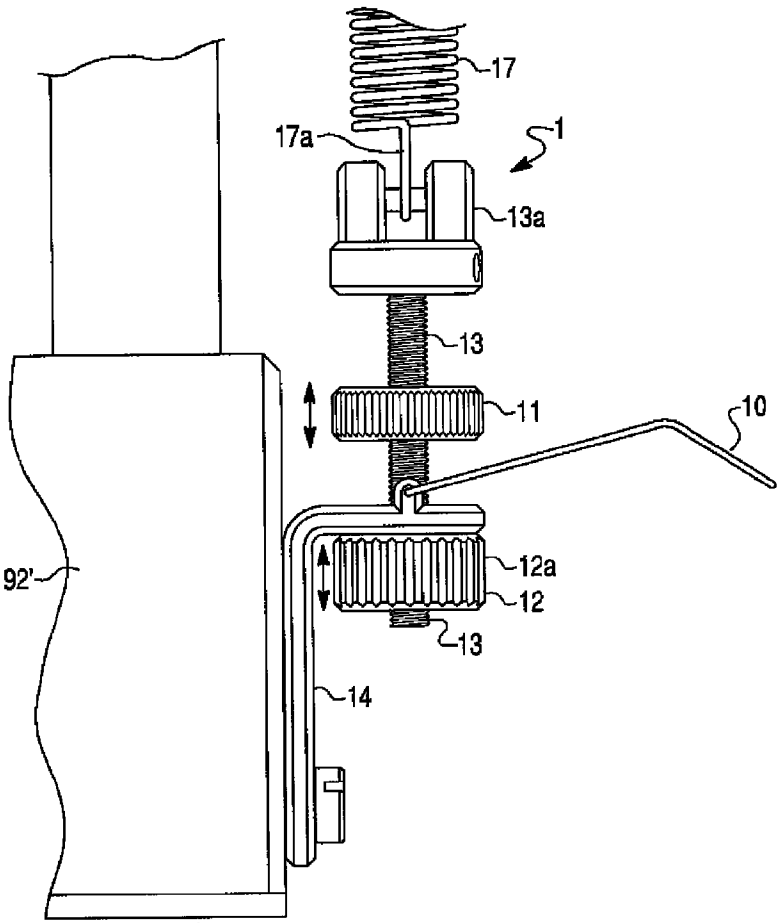
FIG. 4 is a side view of the threaded bolt and flange assemblies with the latch in an open position.

With reference to FIGS. 4 and 5, a spring adjustment mechanism comprises a spring 17 which has a top end secured at the top to the beater shaft of the drum beater assembly through a cam mechanism or other assembly as described in the prior art, and a bottom end 17*a* that is secured to a lock nut mechanism designated generally as reference numeral 1. The lock nut mechanism comprises a threaded adjustment screw or bolt 13 attached to the bottom end of the spring 17 via a suitable connector 13*a*. A lock nut 11 is positioned on the threaded adjustment screw or bolt 13 so that it is able to be rotatably moved along the threaded screw or bolt 13. The bottom of the threaded screw 13 is inserted through a non-threaded flange assembly 14 and capped with a spring tension nut 12. The spring tension nut 12 resembles a gear, having a plurality of teeth 12*a* on its outer circumference. The teeth 12*a* are spaced at regular angular intervals around the outer circumference of the nut 12 to provide a plurality of a selected adjustment positions relative to the support, where the selected adjustment positions are radially disposed about the central axis of rotation of the adjustment screw so that the adjustment screw may be locked into one of the selected adjustment positions relative to the support 92'.

Figure 1:
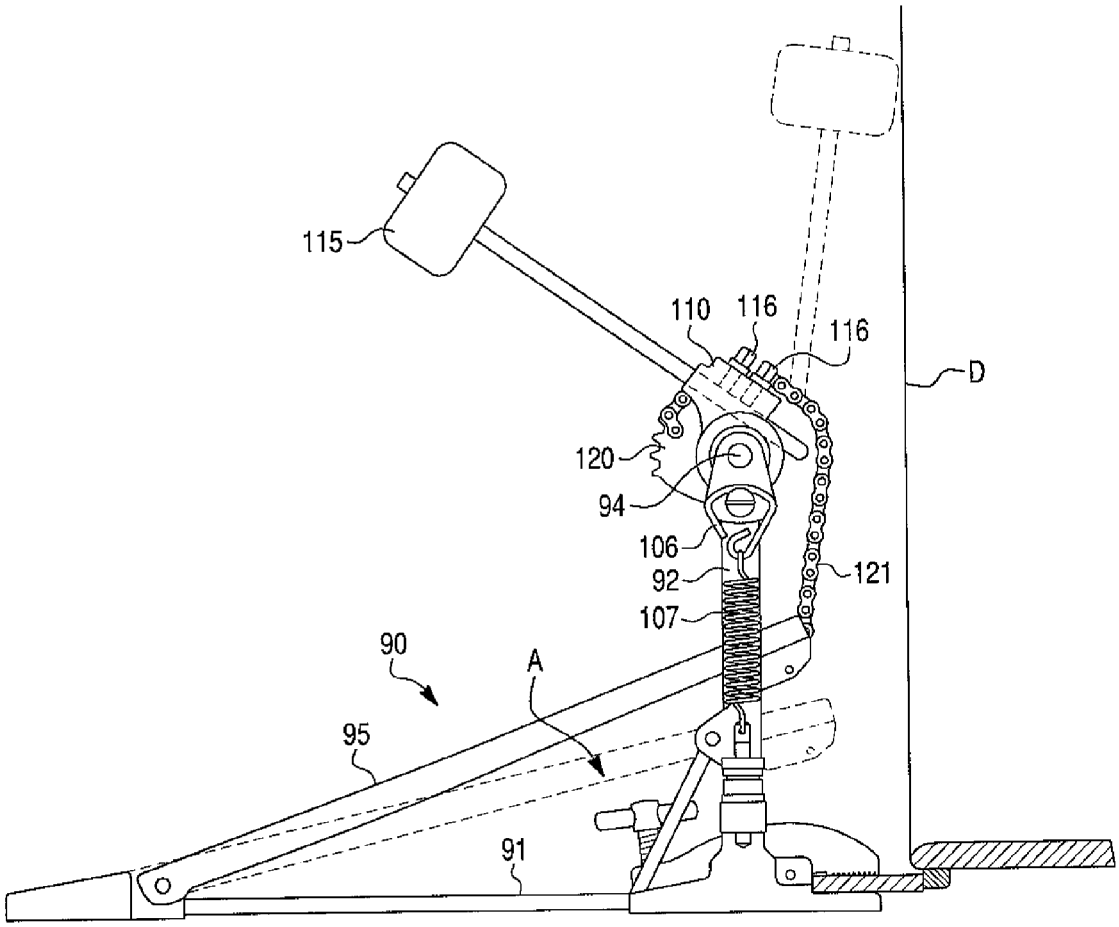
Fig. 1 Prior Art
FIG. 1 is a side view of a spring adjustment mechanism for a drum pedal according to the prior art.
Figure 2:
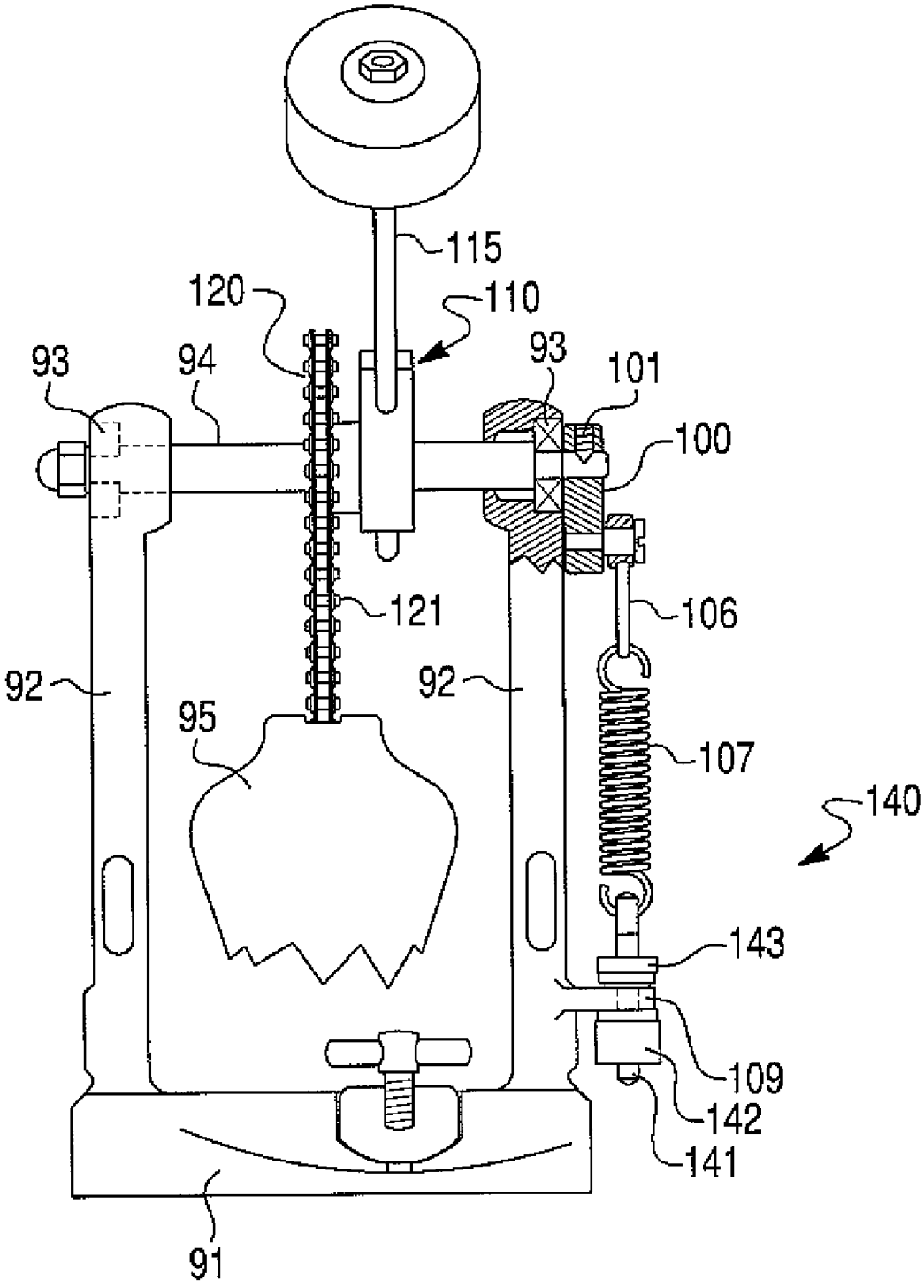
Fig. 2 Prior Art
FIG. 2 is a rear view of the prior art pedal drum pedal with a part thereof shown in cross section.

The flange assembly is comprised of a flange 14 secured to the bottom of the support 92' of the drum beater assembly perpendicularly extending from the bottom of the drum beater assembly. Of course, the flange 14 may be integrally formed with the support 92' as shown in FIGS. 1 and 2 or may be a separate member secured to the support in the manner shown in FIGS. 3-5.

In the embodiment of FIGS. 3-5, the latch system has a hinged latch 10 rotatably attached to the top of the flange 14 so as to allow for pivoting movement or rotation. As shown in FIGS. 4 and 5, the latch 10 can be pivoted down and secured on the spring tension nut 12 by engaging the teeth 12*a* on the spring tension nut 12. Once secured, the latch 10 prevents the spring tension nut 12 from turning and/or traveling up or down the threaded bolt 13 from either deliberate force or normal vibrations from use of the drum pedal and thus changing the tension in the spring 17. As illustrated in FIGS. 4, 5, 7 and 8, the spring tension nut 12 has a number of teeth 12*a* along the outside of the spring tension nut 12. These teeth facilitate securing the spring tension nut 12 to prevent changes to or loosening of the tension of the spring 17 as described previously.

While the latch clip 10 may take many forms, FIGS. 9*a*-9*f* illustrate the preferred embodiment for the latch clip 10 as envisioned by this invention.

Figure 6:
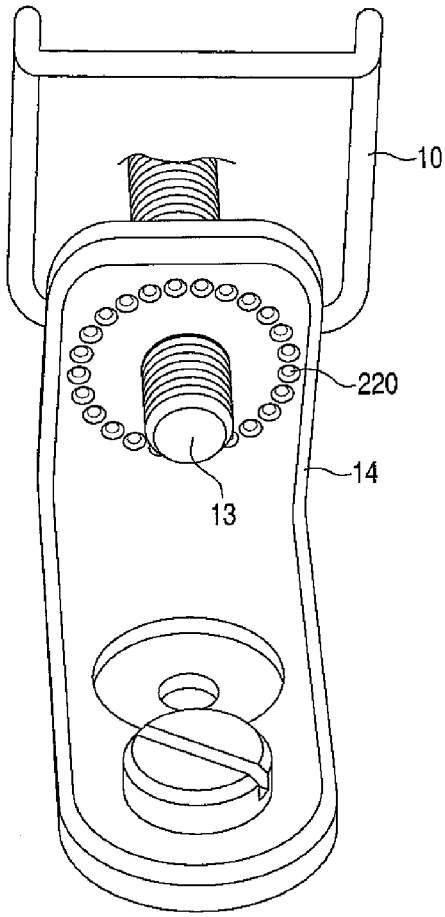
FIG. 6 is a bottom view of the flange assembly and adjustment screw without the spring tension nut in place.

In the preferred embodiment, the bottom of the spring tension nut 12 is formed as a flat surface 211 with recesses 211*a*, while the top of the spring tension nut 12 contains a plurality of bumps or raised dimples 212 arranged in a circular pattern around the spring tension nut. As shown in FIG. 6, the bottom of the flange 14 contains a plurality of concave recesses 220 arranged in a circular fashion around threaded bolt 13 which correspond to and engage with the raised bumps or dimples 212 on the top of the spring tension nut 12. See FIG. 7. The raised dimples 212 provide tactile and aural feedback of the spring tensioning process and the user is provided a measure of relative tightness to a starting position by counting the number of "clicks" of the spring tension nut 12. The concave recesses 220 preferably are equidistant from one another. It is noted that the number of raised dimples 212 and the number of recesses 220 can be modified to change the precision with which the spring tension nut can be adjusted. Likewise, the dimples 212 may be alternately located on the flange 14 and the recesses 220 may be located on the nut 12.

In one preferred embodiment, the latch system using the latch 10 is used in conjunction with the dimples/recesses 212, 220. In this instance, the latch 10 is rotated down to further secure the spring tension nut 12 once the desired tension has been reached. Alternately, these two systems may be used individually to provide the desired spring tension locking system.

As discussed, the spring tension is adjusted by turning the spring tension nut 12 until the desired tension in the spring is achieved. The flange latch 10 is then pivoted down and snapped between the teeth 12*a* of the spring tension nut 12. The spring tension nut 12 is then secured from rotation by the flange latch 10. The lock nut 11 also securely contacts the flange 14 to provide more stability to the assembly. The spring tension nut 12 prevents the lock nut 11 from being loosened from vibrations from use or any other sources.

To release the spring tension nut and change the tension of the spring, the latch is snapped off the teeth on the spring tension nut and pivoted upwards. The spring tension nut can then be moved up or down the threaded bolt freely to adjust the tension in the spring.

Therefore, a change in the tightness of the spring can be prevented and it is easy for a user to control the return speed of the beater rod and beater head.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

The invention claimed is:

1. A spring adjustment mechanism for a drum pedal, comprising:

at least one support;

a beater shaft supported on the support and rotatable around the axis of the shaft;

a drum beater connected to pivot toward and away from a drum as the shaft is rotated;

a drive member on the shaft;

a foot pedal connected with an operating member so that movement of the pedal moves the drive member to rotate the shaft for pivoting the drum beater toward and away from a drum head of a drum as the shaft is selectively rotated in opposite directions;

a spring hooked to the beater shaft such that the spring tension returns the beater shaft to a position of least spring tension;

an adjustment screw interconnected with the spring for adjusting the tension of the spring, the adjustment screw being movable with respect to the support and the beater shaft for adjusting the tension of the spring, a spring tension adjustment nut threadingly engaging said adjustment screw; and a locking system for locking the adjustment screw at one of a plurality of a selected adjustment positions relative to the support, said selected adjustment positions being radially disposed about the central axis of rotation of said adjustment screw so that said adjustment screw is configured to be locked into one of said selected adjustment positions relative to the support;

wherein said locking system comprises a series of teeth disposed on an exterior surface of said adjustment nut and a latch that engages said series of teeth, said series of teeth defining said selected adjustment positions.

2. The adjusting mechanism of claim 1, wherein said locking system comprises a first series of interlocking members disposed on a projection extending from said support and a second series of interlocking members disposed on said adjustment nut, said first and second series of interlocking members defining said selected adjustment positions.

3. The adjusting mechanism of claim 2, wherein said first and second series of interlocking members comprises a plurality of recesses and a corresponding plurality of projections that mate to lock said adjustment nut relative to said support.

4. The adjusting mechanism of claim 3, wherein said first and second series of interlocking members emit a clicking sound when said nut is rotated relating to said support to assist the user when adjusting said tension of said spring.

5. The adjusting mechanism of claim 1, wherein said support comprises a vertical post having a flange extending horizontally therefrom.

6. The adjusting mechanism of claim 1, wherein said latch is a pivoting latch mounted to said support.

7. The adjusting mechanism of claim 6, wherein said pivoting latch resiliently engages said series of teeth at one of said selected adjustment positions such that said locking system provides a snap-fit connection between said pivoting latch and said series of teeth on said nut.

8. The adjusting mechanism of claim 1, further comprising locking means on the adjustment screw movable for selectively causing engagement of the locking system and permitting disengagement thereof.

9. The adjusting mechanism of claim 8, wherein the locking means comprises a lock nut on the adjustment screw above a horizontal flange on the support on the side thereof away from the adjustment nut, the lock nut being tightenable toward the horizontal flange and the adjustment nut for moving the locking system into engagement.

10. A spring adjustment mechanism for a drum pedal, comprising:

at least one support;

a beater shaft supported on the support and rotatable around the axis of the shaft;

a spring hooked to the beater shaft such that the spring tension returns the beater shaft to a position of least spring tension;

an adjustment screw interconnected with the spring for adjusting the tension of the spring, the adjustment screw being movable with respect to the support and the beater shaft for adjusting the tension of the spring, a spring tension adjustment nut threadingly engaging said adjustment screw; and a locking system for locking the adjustment screw at one of a plurality of a selected adjustment positions relative to the support, said selected adjustment positions being radially disposed about the central axis of rotation of said adjustment screw so that said adjustment screw may be locked into one of said selected adjustment positions relative to the support, wherein said locking system comprises a series of teeth disposed on an exterior surface of said adjustment nut and a latch that engages said series of teeth, said series of teeth defining said selected adjustment positions.

11. The adjusting mechanism of claim 10, wherein said latch is a pivoting latch mounted to said support.

12. The adjusting mechanism of claim 11, wherein said pivoting latch resiliently engages said series of teeth at one of said selected adjustment positions such that said locking system provides a snap-fit connection between said pivoting latch and said series of teeth on said nut.

* * * * *